United States Patent [19]

Nose et al.

[11] Patent Number: 5,010,756

[45] Date of Patent: Apr. 30, 1991

[54] METHOD OF AND APPARATUS FOR CONTROLLING SHAPE OF ROLLED MATERIAL ON MULTI-HIGH ROLLING MILL

[75] Inventors: Kazuo Nose; Hiroyuki Yamamoto; Shiro Koike; Masakazu Shimomura, all of Kobe; Hajime Tsubono, Neyagawa; Soichi Kitagawa, Kobe; Yasumasa Fujisaki, Kobe; Yasushi Maeda, Kobe; Tetsuya Wakebe, Kobe; Yasuyuki Katayama, Kobe, all of Japan

[73] Assignee: Kabushiki Kaisha Kobe Seiko Sho, Kobe, Japan

[21] Appl. No.: 442,534

[22] Filed: Nov. 28, 1989

[30] Foreign Application Priority Data

| | | | |
|---|---|---|---|
| Nov. 29, 1988 | [JP] | Japan | 63-299495 |
| Mar. 3, 1989 | [JP] | Japan | 1-49774 |
| Aug. 30, 1989 | [JP] | Japan | 1-221803 |

[51] Int. Cl.[5] ..... B21B 37/02

[52] U.S. Cl. ..... 72/9; 72/12; 72/16; 72/240; 72/241.4; 72/242.4

[58] Field of Search ..... 72/8, 9, 11, 12, 10, 72/16, 240, 241.4, 242.4

[56] References Cited

U.S. PATENT DOCUMENTS

| | | | |
|---|---|---|---|
| 3,248,916 | 5/1966 | Kenyon et al. | 72/12 |
| 3,731,508 | 5/1973 | Sabatini et al. | 72/9 |
| 3,892,112 | 4/1975 | Smith, Jr. | 72/11 |
| 4,551,805 | 11/1985 | Shimoda et al. | 72/11 |

FOREIGN PATENT DOCUMENTS

| | | | |
|---|---|---|---|
| 0072712 | 5/1982 | Japan | 72/9 |
| 0202109 | 11/1984 | Japan | 72/11 |
| 0108903 | 5/1988 | Japan | 72/8 |
| 0212007 | 9/1988 | Japan | 72/11 |
| 7008555 | 12/1970 | Netherlands | 72/8 |

*Primary Examiner*—Lowell A. Larson
*Assistant Examiner*—T. C. Schoeffler
*Attorney, Agent, or Firm*—Oblon, Spivak, McClelland, Maier & Neustadt

[57] ABSTRACT

A method of and a device for controlling a counter of a rolled material on a multi-high rolling mill with which method and device very accurate shape control can be attained with certainty and in high responsibility. A strip shape of a rolled material in its widthwise direction on the outgoing side of the rolling mill is detected by a strip shape meter, and the detected shape and a strip thickness are synthetically evaluated using a total performance index. Operation amounts for a strip shape controlling actuator and a strip thickness controlling actuator which make the value of the total performance index minimum are always found out, and the actuators are controlled simultaneously in accordance with the operation amounts to control the strip shape of the rolled material. The apparatus comprises a saddle receiver the vertical position of which is controlled by a roll gap controlling device in accordance with an estimated value to change the gap between upper and lower work rolls of the rolling mill.

6 Claims, 4 Drawing Sheets

METHOD OF AND APPARATUS FOR CONTROLLING SHAPE OF ROLLED MATERIAL ON MULTI-HIGH ROLLING MILL

BACKGROUND OF THE INVENTION

1. Field of the Invention

This invention relates to a method of and an apparatus for controlling the shape of a rolled material on a multi-high rolling mill such as, for example, a 12-high or 20-high rolling mill in which automatic strip thickness control and automatic strip shape control are performed in the rolling of a strip.

2. Description of the Prior Art

In recent years, in the rolling of a strip of a copper alloy or the like, not only is automatic strip thickness control executed on a multi-high rolling mill in order to meet a requirement for accuracy in strip thickness, but also a high degree of accuracy is required for the shape of a strip and accordingly an automatic shape controlling method has been developed.

For example, in a rolling mill of the type wherein a strip thickness is controlled with a roll depressing position while a shape is controlled with a forcing amount of backup rolls or a shifting amount of taper rolls, strip shape control is conventionally executed such that a shape of a strip in a widthwise direction (elongation of a rolled material in the rolling direction) is approximated with a quadric expression in response to a signal from strip shape meters. Coefficients of individual terms of the quadric expression are divided into symmetrical components and asymmetrical components to fix a shape and strip shape controlling actuators are operated in accordance with such components (Japanese Patent Laid-Open No. 54-151066. Japanese Patent Laid-Open No. 55-19401. Japanese Patent Laid-Open No. 55-42144). It is also a common practice that a change in strip thickness caused by a change in operation amount of such strip shape controlling actuators is forecast and a roll depressing position is modified in accordance with a predetermined calculation expression to prevent a change in strip shape (Japanese Patent Laid-Open No. 60-3908. Japanese Patent Laid-Open No. 60-3909).

However, since work rolls in a multi-high rolling mill are small in diameter, a complicated composite elongation including edge wave, a center buckle and so forth often takes place in a shape of a strip. Accordingly, if fixation of a shape of a rolled material is performed and controlled on a multi-high rolling mill involving such an approximation with a quadric expression as described above, sufficiently good shape control cannot be attained.

On the other hand, when the strip shape controlling actuators are operated, even if a change in strip thickness is forecast to change the roll depressing position, a vicious cycle takes place wherein also the shape changes as the roll depressing position changes. Accordingly, there is another problem that control cannot be attained with a high degree of accuracy.

Further, when the condition of a shape is remarkably bad such as at an initial stage of rolling, the level of signals outputted from shape controlling devices to shape controlling actuators is so high that some of the actuators may not follow a target signal from a restriction arising from a response characteristic. As a result, there is a further problem that the improvement in shape is delayed.

Further, in case noise is involved in a strip shape from a shape detecting device at each point of time, it is also desired to eliminate a possible error in operation which may be caused by such noise.

Meanwhile, a multi-high rolling mill has been developed which includes, in order to control the shape of a rolled material in a widthwise direction finely and accurately, a crown controlling device which includes a mechanism wherein a plurality of axially divided backup rolls are supported by means of saddles such that the forcing amounts of the individual divided backup rolls can be adjusted individually by way of the saddles and which locally controls the forcing amounts of the individual backup rolls to control the crown shape of a rolled material, an inclined depression controlling device which includes depressing driving mechanisms on the driving side and the working side so that the gap between upper and lower work rolls may be relatively adjusted between the driving side and the working side, and a lateral controlling device wherein intermediate rolls having tapers at the opposite end portions thereof are provided for axial movement in order to change deflections at the opposite end portions of the work rolls and the axial (lateral) positions of the intermediate rolls are adjusted.

Each of the controlling devices listed above operates as a strip shape controlling device for controlling the strip shape of a rolled material, and the strip shape of a rolled material is controlled finely and accurately by adjusting an operation amount of a strip shape controlling actuator with each of the controlling devices, that is, by adjusting a forcing amount of each of the divided backup rollers, a relative gap between the upper and lower work rolls on the driving side and the working side, and the axial positions of the intermediate rolls.

However, in such a multi-high rolling mill, if an operation amount of a strip shape controlling actuator is adjusted with a shape controlling device in order to control the shape of a rolled material, not only the strip shape of the rolled material is changed, but also an influence of the same is had on the outgoing side strip thickness of the rolled material, which will result in variation of the strip thickness. Consequently, there is a problem that control with a high degree of accuracy cannot be attained.

SUMMARY OF THE INVENTION

It is an object of the present invention to provide a method of and a device for controlling a counter of a rolled material on a multi-high rolling mill so that very accurate shape control can be attained with certainty and in high responsibility.

In order to attain the object, according to one aspect of the present invention, there is provided a method of controlling the shape of a rolled material on a multi-high rolling mill which includes a strip shape meter for detecting an elongation in a rolling direction of a rolled material on the outgoing side of the multi-high rolling mill as a strip shape, a strip shape controlling actuator for controlling the strip shape of the rolled material, a strip thickness controlling actuator for controlling a strip thickness of the rolled material, a strip shape controlling device for outputting an operation amount to the strip shape controlling actuator to control the strip shape controlling actuator in accordance with a result of detection by the strip shape meter, and a strip thickness controlling device for outputting an operation amount to the strip thickness controlling actuator to control the strip thickness controlling actuator, wherein the strip shape and the strip thickness of the rolled material are controlled by the strip shape controlling device and the strip thickness controlling device while correcting the operation amount from the strip thickness controlling device taking into consideration a change of the strip thickness which is caused by changing the operation amount of the strip shape controlling actuator. The method comprises the steps of defining and setting in advance a total performance index with which a strip shape and a strip thickness on the outgoing side of the rolled material are to be evaluated using a difference between a preset target strip shape and a strip shape on the outgoing side of the multi-high rolling mill detected by the strip shape meter and a difference between a strip thickness variation caused by a change of the operation amount of each of the actuators and a preset target strip thickness variation upon changing of the operation amount of each of the actuators, normally detecting, during strip shape control of the rolled material, the strip shape of the rolled material by means of the strip shape meter, calculating, in accordance with a result of detection from the strip shape meter, operation amounts for the strip shape controlling actuator and the strip thickness controlling actuator which makes the value of the total performance index minimum, and controlling the strip shape controlling actuator in accordance with an operation amount calculated by the strip shape controlling device and controlling the strip thickness controlling actuator in accordance with an operation amount obtained by adding an operation amount calculated by the strip shape controlling device to an operation amount from the strip thickness controlling device.

According to another aspect of the present invention, at the defining and setting step described above, a total performance index with which a strip shape and a strip thickness on the outgoing side of the rolled material are to be evaluated is defined and set using a difference between a present target strip shape at present and a strip shape at present on the outgoing side of the multi-high rolling mill detected by the strip shape meter and a difference between a strip thickness variation caused by a change of the operation amount of each of the actuators and a preset target strip thickness variation upon changing of the operation amount of each of the actuators.

With the method of controlling the shape of a rolled material on a multi-high rolling mill, an outgoing side strip shape of a rolled material in its widthwise direction is detected by the strip shape meter, and the outgoing side strip shape and the strip thickness are synthetically evaluated using a total performance index. In short, operation amounts for the strip shape controlling actuator and the strip thickness controlling actuator which minimizes the value of the total performance index are discovered, and the individual actuators are controlled simultaneously in accordance with the operation amounts thus obtained to control the strip shape of the rolled material. Accordingly, there is no necessity of performing such shape fixation of the rolled material as in the prior art. Besides, when the strip shape controlling actuator is operated, no such vicious cycle takes place that a change of the roll depressing position which is conducted involving a forecast of a variation of the strip thickness results in another change of the shape. Accordingly, there is an effect that shape control with a very high degree of accuracy can be achieved with certainty.

According to a further aspect of the present invention, at the calculating step described above, operation amounts for the strip shape controlling actuator and the strip thickness controlling actuator which minimizes the value of the total performance index are calculated in accordance with a result of detection from the strip shape meter and a limit of movement of each of the actuators which depends upon a current position and an upper limit of the moving speed of the actuator. According to a still further aspect of the present invention, at the defining and setting step described above, a total performance index with which a strip shape and a strip thickness on the outgoing side of the rolled material are to be evaluated is defined and set using a difference between a preset target strip shape at present and a strip shape at present on the outgoing side of the multi-high rolling mill detected by the strip shape meter and a difference between a strip thickness variation caused by a change of the operation amount of each of the actuators and a preset target strip thickness variation upon changing of the operation amount of each of the actuators.

With the method of controlling the shape of a rolled material on a multi-high rolling mill, since a limit of movement of each of the actuators which depends upon a current position and an upper limit of the moving speed of the actuator is taken into consideration upon calculation of operation amounts for the actuators, there is an effect that such a situation can be prevented that some of the actuators may not follow a target signal from a restriction arising from a response characteristic. Also there is an advantage that the responsibility in strip shape control can be improved.

Preferably, an operation amount is calculated after a difference between a strip shape at present on the outgoing side of the multi-high rolling mill detected by the strip shape meter and a preset target strip shape at present is replaced by a weighted average value of a sequence of data of differences of strip shapes at present and in the past on the outgoing side of the multi-high rolling mill detected by the strip shape meter from corresponding preset target strip shapes at present and in the past. Thus, since a weighted average value of differences between detected strip shapes and target strip shapes at present and in the past is adopted as a source of calculation for a control amount, suitable selection of a weight or weights is equivalent to removal of noises included in the differences or to execution of PID (proportional-integration-differentiation) control based on the differences, and consequently, such adjustment as coping with a situation such as quick responsibility in shape modification or improvement in steady-state deviation is made possible. Accordingly, a shape improving characteristic can be selected.

According to a yet further aspect of the present invention, there is provided an apparatus for controlling the shape of a rolled material on a multi-high rolling mill including a crown controlling device for locally controlling the forcing amount of each of a plurality of axially divided backup rolls which are supported on saddles, an inclined depression controlling device for adjusting the gap between the upper and lower work rolls relatively between the driving side and the working side by means of depressing driving mechanisms provided on the driving side and the working side, and a lateral controller for adjusting the axial positions of intermediate rolls each of which has a taper at each of the opposite end portions thereof and is mounted for movement in its axial direction in order to to change deflections at the opposite end portions of the upper and lower work rolls, which apparatus comprises a saddle receiver on which the plurality of divided backup rolls are placed by way of the saddles, a roll gap controlling device for moving the saddle receiver upwardly or downwardly to change and control the gap between the upper and lower work rolls uniformly in the axial direction, operation amount detecting means for individually detecting operation amounts of the crown controlling device, inclined depression controlling device and lateral controlling device, and an estimating means for estimating a variation of the strip thickness of the rolled material on the outgoing side of the multi-high rolling mill in accordance with influence coefficients obtained in advance as amounts of influences which are to be had on the strip thickness of the rolled material on the outgoing side by variations of the operation amounts caused by the crown controlling device, inclined depression controlling device and lateral controlling device and also with variations of the individual operation amounts detected by the operation amount detecting means, wherein the roll gap controller controls the vertical position of the saddle receiver in accordance with an estimated value from the estimating means so as to cancel a change of the strip thickness of the rolled material on the outgoing side corresponding to the estimated value in order to change the gap between the upper and lower work rolls uniformly in the axial direction.

With the apparatus for controlling the shape of a rolled material on a multi-high rolling mill, when control of the strip shape of a rolled material is performed by the crown controlling means, inclined depression controlling device and lateral controlling device, operation amounts by the individual controlling devices are detected by the operation amount detecting means, and at the estimating means, a variation of the outgoing side strip thickness of the rolled material is estimated in accordance with results of such detection and influence coefficients (amounts of influence of a variation of the operation amount by each of the controlling devices on the outgoing side strip thickness of the rolled material) found out in advance. Then, the vertical position of the saddle receiver is controlled by the roll gap controlling device in accordance with the estimated value so that the gap between the upper and lower work rolls is changed uniformly in the axial direction. Consequently, a possible change of the outgoing side strip thickness of the rolled material corresponding to the estimated value is cancelled. Accordingly, there is an effect that shape control with a very high degree of accuracy can be achieved with certainty.

The above and other objects, features and advantages of the present invention will become apparent from the following description and the appended claims. taken in conjunction with the accompanying drawings in which like parts are denoted by like reference characters all through the drawings.

DETAILED DESCRIPTION OF THE PREFERRED EMBODIMENTS

Figure 1:
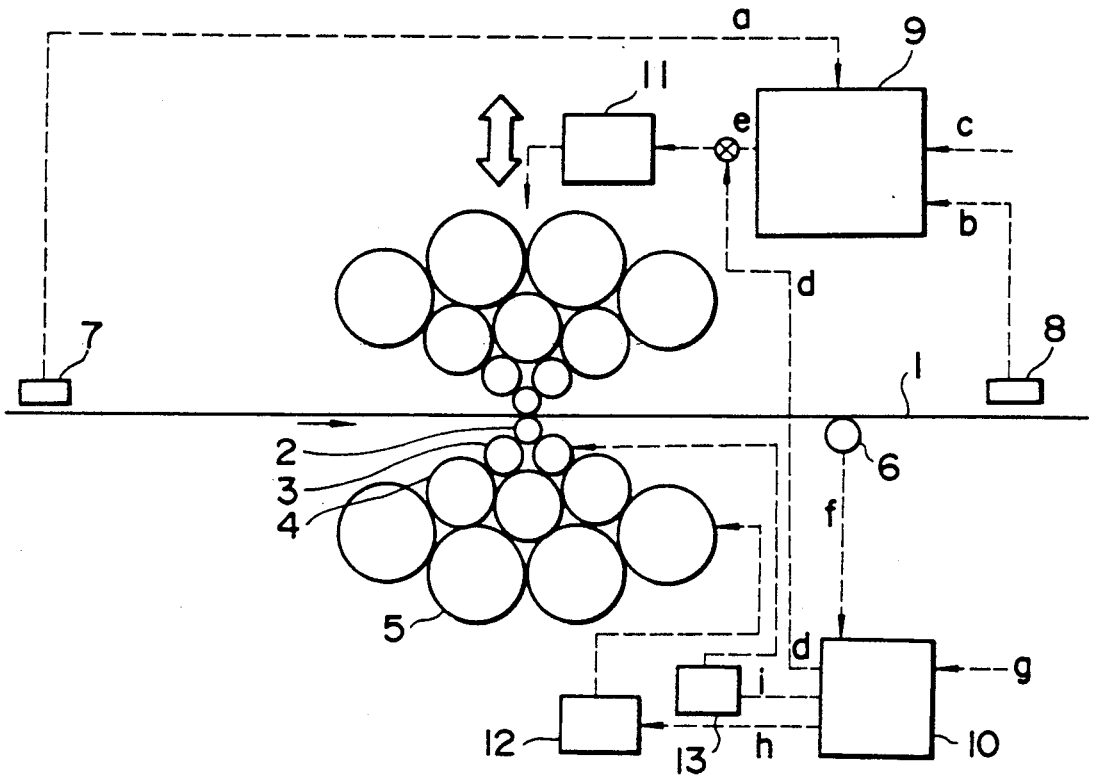
FIG. 1 is a diagrammatic representation of an entire multi-high rolling mill to which a controlling method according to the present invention is applied.
Figure 2:
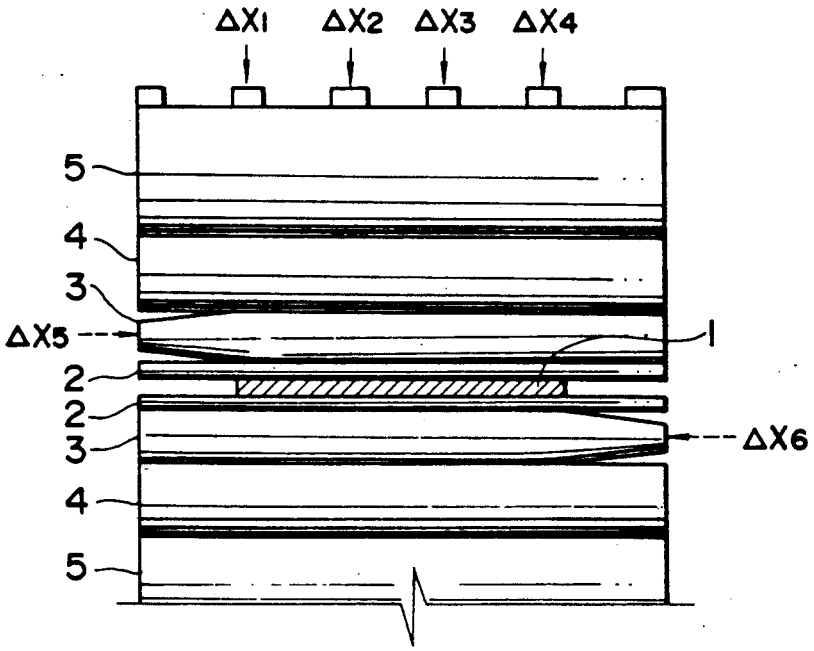
FIG. 2 is a front elevational view of the multi-high rolling mill to which the method of the present invention is applied.

Referring first to FIGS. 1 and 2, there is shown a 20-high rolling mill to which a method of the present invention is applied. The 20-high rolling mill shown includes a pair of upper and lower work rolls 2 for contacting a rolled material 1 in the form of a thin strip, two first intermediate rolls 3 in the form of taper rolls disposed behind each of the work rolls 2, three second intermediate rolls 4 disposed behind each set of the first intermediate rolls 3, and four backup rolls 5 disposed behind each set of the second intermediate rolls 4.

A strip shape meter 6 is disposed at a location on the downstream side spaced by a small distance from the 20-high rolling mill and detects an elongation of the rolled material 1 in the rolling direction (strip shape). The strip shape meter 6 is composed of a plurality of or n (integer) shape sensor elements disposed in the widthwise direction of the rolled material 1. A pair of strip thickness meters 7 and 8 are disposed at suitable positions on the upstream side and the downstream side of the 20-high rolling mill for detecting an incoming side strip thickness and an outgoing side strip thickness of the rolled material 1, respectively. A strip thickness controlling device 9 receives the results of detection from the strip thickness meters 7 and 8 and delivers, in response to the results of detection received, operation amounts as controlling signals e to a suitable number of roll depressing position moving means (strip thickness controlling actuators) 11. A strip shape controlling device 10 receives a result of detection from the strip shape meter 6 and develops, in response to such result of detection received, operation amounts to a suitable number of backup roll forcing means 12 and taper roll moving means 13 (which serve as strip shape controlling actuators).

With the device having such a construction as described above, strip shape control of the rolled material 1 according to a method of the present invention proceeds in the following manner.

At first, the strip thickness controlling device 9 calculates operation amounts in accordance with detection signals a and b from the strip thickness meters 7 and 8 and a preset target outgoing side strip thickness signal c by ordinary feedforward type strip thickness control and feedback type strip thickness control and develops a controlling signal e. Another controlling signal d which is an operation amount calculated by the strip shape controlling device 10 is added to the controlling signal e to make a correction which involves a change in strip thickness which is caused by changing of operation amounts of the backup roll forcing means 12 and the taper roll moving means 13. After such correction, the controlling signal, is transmitted to the roll depressing position moving means 11 so that the roll depressing position in the 20-high rolling mill is operated in accordance with the thus instructed operation amount to control the strip thickness of the rolled material 1.

Meanwhile, the strip shape controlling device 10 calculates, in accordance with a detection signal f from the strip shape meter 6 and a preset target strip shape signal g, operation amounts Δx1 to Δx4 for the backup roll forcing means 12 (that is, variations of forcing amounts of the backup rolls 5), operation amounts Δx5 and Δx6 for the taper roll moving means 13 (that is, moving amounts for the pair of upper and lower taper rolls 3) and operation amount Δx7 and Δx8 for the roll depressing position moving means 11 (that is, correction amounts to be added to the controlling signal e from the strip thickness controlling device 9), and outputs them as controlling signals h, i and d, respectively. Then, the positions of the backup rolls 5 and the taper rolls 3 are operated in accordance with operation amounts instructed by the controlling signals h and i by the backup roll forcing means 12 and the taper roll moving means 13 to control the strip shape of the rolled material 1.

The characteristic point of the method of the present invention resides in the calculation of the operation amounts Δx1 to Δx8 to be carried out by the strip shape controlling device 10. Such calculations will be described in detail below.

In particular, the strip shape controlling device 10 has a total performance index J defined and set in advance with which a strip shape and a strip thickness on the outgoing side of the rolled material 1 is evaluated by an equation (1) given hereinbelow.

The total performance index J is defined using a difference between an outgoing side strip shape from the strip shape meter 6 and a preset target strip configuration [(f1$^n$−f1* ): i=1∼n] and a difference between a strip thickness variation corresponding to a change in operation amount of each of the actuators 11 to 13 and a preset target strip thickness variation upon changing of an operation amount of each of the actuators 11 to 13 [(f1$^o$−f1*): i=n+1].

$$J = \sum_{i=1}^{n+1} (f_i^0 - f^*)^2 \cdot w_i^2 \tag{1}$$

where f1$^o$ (i=1∼n) is a measured strip elongation value by the i-th one of the shape sensor elements which constitute the strip shape meter 6: f1*(i=1∼n), is a target strip elongation value for the i-th shape sensor element: fn+1$^o$ is a strip thickness changing amount for a change of an operation amount of each of the actuators 11 to 13: fn+1* is a target strip thickness changing amount upon changing of an operation amount of each of the actuators 11 to 13: and w1 (i=1∼n+1) is a weight coefficient for a deviation between f1$^o$ and f1*.

While such performance index J is introduced, an influence coefficient expression for a strip shape and a strip thickness of the rolled material 1 accompanying a change of an operation amount of each of the actuators 11 to 13 is produced as an equation (2) below.

$$\Delta f_i = \sum_{j=1}^{m} \alpha ji \cdot \Delta xj \; (i = 1 \sim n + 1) \tag{2}$$

where Δxj (j=1∼m: m=8 in the present embodiment) is a changing amount of an operation amount of each of the actuators 11 to 13 to be calculated here: Δf1 (i=i∼n) is a shape variation detected by the i-th shape sensor element when the operation amount of each of the actuators 11 to 13 is changed by Δxj (j=1∼m): Δfn+1 is a strip thickness variation detected by the strip thickness between meter 8 when the operation amount of each of the actuators 11 to 13 is changed by Δxj (j=1∼m), and αj1 (j=1∼m, i=1∼n+1) is an influence coefficient of Δxj upon Δf1.

Then, $$f1^o - f1^* = \Delta f1 (i = 1 \sim n + 1) \tag{3}$$

is substituted into the equation (1) above, and each operation amount changing amount Δxj (j=1∼m) is calculated in accordance with the following algorithm from a strip shape detection value f1$^o$ (i=i∼n) of the rolled material 1 which is detected from time to time by the strip shape meter 6 during the strip shape control such that the total performance index J for the strip thickness and the strip configuration may be minimized from time to time, and each of the actuators 11 to 13 is controlled with the operation amount changing amount Δxj.

Now, if it is assumed that the deviation signal εi (i=1∼n+1) is given by $$\epsilon i = f1^o - f1^* (i = 1 \sim n) : \epsilon n + 1 = 0 \tag{4}$$

and each of the actuators 11 to 13 is moved by Δxj, then the total performance index J is represented as $$J = \sum_{i=1}^{n+1} \left( \epsilon i + \sum_{j=1}^{m} \alpha ji \cdot \Delta xj \right)^2 \cdot w_i^2 \tag{5}$$

In order to minimize the total performance index J, an equation $$\frac{\partial J}{\partial \Delta x_k} = 0 \; (k = 1 \sim m) \tag{6}$$

must be met. In particular, from the equations (5) and (6) above, an equation $$\sum_{i=1}^{n+1} \left( \epsilon i + \sum_{j=1}^{m} \alpha ji \cdot \Delta xj \right) \cdot w_i^2 \cdot \alpha ki = 0 \quad (k = 1 \sim m) \tag{7}$$

is obtained. By solving the equation (7) with Δxj, a changing amount of an operation amount of each of the actuators 11 to 13 for minimizing the total performance index J for the strip thickness and the strip shape is obtained. In short, $$\Delta x = -(A^T W^2 A)^{-1} A^T W^2 E \tag{8}$$

$$\Delta x = \begin{pmatrix} \Delta x_1 \\ \cdot \\ \cdot \\ \cdot \\ \Delta x_m \end{pmatrix} \tag{9}$$

$$A = \begin{pmatrix} \alpha_{11} & \cdots & \alpha_{m1} \\ \cdot & \cdot & \cdot \\ \cdot & \cdot & \cdot \\ \cdot & \cdot & \cdot \\ \alpha_{1n+1} & \cdots & \alpha_{mn+1} \end{pmatrix}$$

-continued $$W = \begin{pmatrix} w_1 & 0 & \cdot & \cdot & \cdot & 0 \\ 0 & w_2 & \cdot & \cdot & \cdot & 0 \\ \cdot & & \cdot & & & \cdot \\ \cdot & & & \cdot & & \cdot \\ \cdot & & & & \cdot & \cdot \\ 0 & \cdot & \cdot & \cdot & 0 & w_{n+1} \end{pmatrix}$$

$$E = \begin{pmatrix} \epsilon_1 \\ \epsilon_2 \\ \cdot \\ \cdot \\ \cdot \\ \epsilon_n \\ 0 \end{pmatrix}$$

are obtained. It is to be noted that "$T$" in the equation (8) above denotes transposition of the matrix.

According to the algorithm described above, when the condition of the shape is remarkably bad such as at an initial stage of rolling, the control target signal level is excessively high, and some of the actuators 11 to 13 may not be able to follow a target signal from a restriction of the responsibility characteristic. Accordingly, in the case of the present embodiment, the following steps (1) to (7) are executed by the strip shape controlling device 10 in order to prevent appearance of such actuators 11 to 13 which cannot follow a target signal.

(1) A movable speed of each of the actuators 11 to 13 is calculated in accordance with a function defined in advance in accordance with rolling conditions (rolling speed, rolling load).

(2) From a current position of each actuator, a movable limit value which is restricted from the position limitation is calculated.

(3) A movable limit value for one control cycle of each of the actuators 11 to 13 which can be determined from the movable speed is calculated.

(4) A smaller one of the movable limit values calculated at steps (2) and (3) is set as a final movable limit value.

(5) A moving amount target value of each of the actuators 11 to 13 which minimizes the total performance index J is calculated from a deviation shape between a detected shape from the strip shape meter 6 and the target shape as described above.

(6) In case there is an actuator for which the target value calculated at the preceding step (5) exceeds the movable limit value calculated at step (4), the moving amount target value for the actuator is substituted into the movable limit value, and a shape changing amount when the actuator moves to the movable limit value is calculated. Then, the shape changing amount is subtracted from the deviation shape, and the actuator is excepted from available actuators, whereafter moving target values for the remaining actuators which minimize the total performance index J at step (5) are calculated, and checking of limits of movement is performed. This will be repeated either until all of the actuators are free from the restriction of the limits of movement or until none of the actuators 11 to 13 becomes available.

(7) A control gain is multiplied to calculate a final moving target value for each of the actuators 11 to 13.

In the present embodiment, the operation amounts for the actuators 11 to 13 obtained in this manner are controlled in accordance with $\Delta xj$ ($j=1\sim8$) to execute strip shape control of the rolled material 1 by means of the roll depressing position moving means 11, backup roll forcing means 12 and taper roll moving means 13 described hereinabove.

It is to be noted that, in case an error is not applied to a detection value of a shape, it is effective to calculate a time weighted average value of differences between a detected shape and a target shape and substitute the value into E of the equation (1) to calculate an operation value. Further, if the weight at present is set to a positive value and the weight in the past is set to 0, then a so-called integrating operation is obtained, and if the weight at present is set to a positive value and the weight at a point of time a predetermined interval of time ago is set to a negative value while the weight at a point of time two predetermined intervals of time ago is set to 0, then a proportional+integrating operation is obtained. By suitably selecting the weight coefficients in this manner, PID (proportional-integration-differentiation) control based on an error can be realized, and improvements in transient response and steady-state response can be attained.

Figure 3:
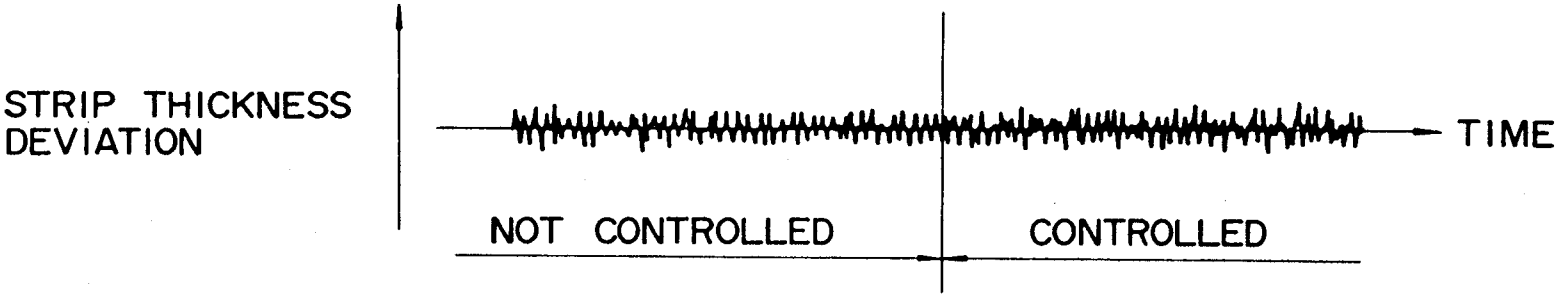
FIGS. 3 and 4(*a*), 4(*b*) are graphs illustrating operation of the multi-high rolling mill.
Figure 4A:
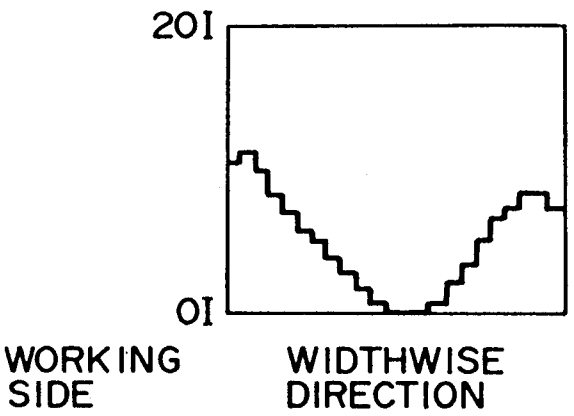
Figure 4B:
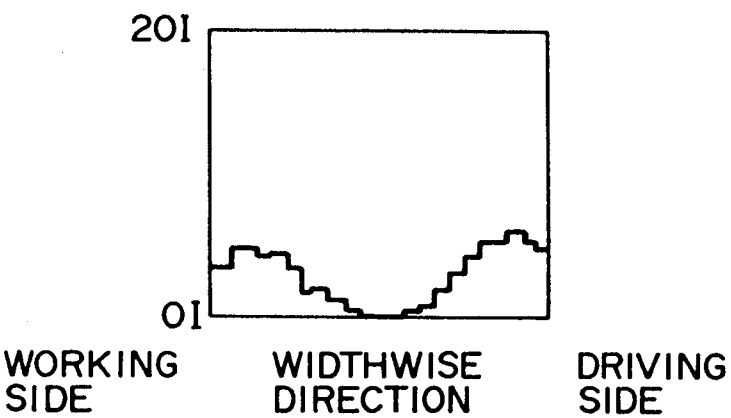

Results of an examination which was performed applying the method of the present invention to actual shape control of a rolled material are illustrated in FIGS. 3 and 4(*a*), 4(*b*). Here, the examination was conducted under the conditions of a rolled material made of a copper alloy and having a strip width of 630 mm and a strip thickness of 205 μm. FIG. 3 shows a strip thickness deviation when the control by the method of the present invention is executed and stopped while FIGS. 4(*a*) and 4(*b*) illustrate elongations of a rolled material in its rolling direction when the control by the method of the present invention is not executed and is executed, respectively. In FIGS. 4(*a*) and 4(*b*), a 1 I-unit which is a unit of the axis of ordinate represents that the elongation of a rolled material having a length of 1 m in its rolling direction is greater by $10^{-5}$ m than a reference value.

It can be seen that the strip shape is improved remarkably before and after a changing over timing between execution and stopping of the shape control according to the present invention as shown in FIGS. 4(*a*) and 4(*b*), but the accuracy in strip thickness presents little change (little deterioration) before and after the changing over timing between execution and stopping of the shape control.

In this manner, according to the rolled material shape controlling method of the present embodiment, an outgoing side strip shape and strip thickness are evaluated synthetically using a total performance index J. and an operation amount of each of the actuators 11 to 13 which makes the value of the total performance index J minimum is found out normally, and then the individual actuators 11 to 13 are controlled at the same time in accordance with the operation amounts obtained in order to control the strip shape of the rolled material 1. Accordingly, such shape fixation of the rolled material as in the prior art need not be performed, and such a vicious cycle that, in case the strip shape controlling actuators are operated, a change of the roll depressing position which is performed involving a forecast of a variation of the strip thickness results in another change in shape does not take place any more. Accordingly, shape control can be accomplished with a very high degree of accuracy and with certainty.

Further, according to the present embodiment, in executing the steps (1) to (7) described above to calculate operation amounts of the actuators 11 to 13, as limits of movement of the individual actuators 11 to 13 which depend upon current positions and upper limits in moving speed of the individual actuators are taken into consideration particularly when the bad shape condition is remarkable such as at an initial stage of rolling, it can be prevented that the levels of signals from the strip shape controlling device 10 to the individual actuators 11 to 13 become excessively high so that some of the actuators cannot follow the target signals from a restriction arising from a response characteristic. Accordingly, the responsibility in strip shape control can be improved.

It is to be noted that, while the method of the present invention is applied, in the present embodiment, to a 20-high rolling mill, it can naturally be applied to any other multi-high rolling mill.

Figure 5:
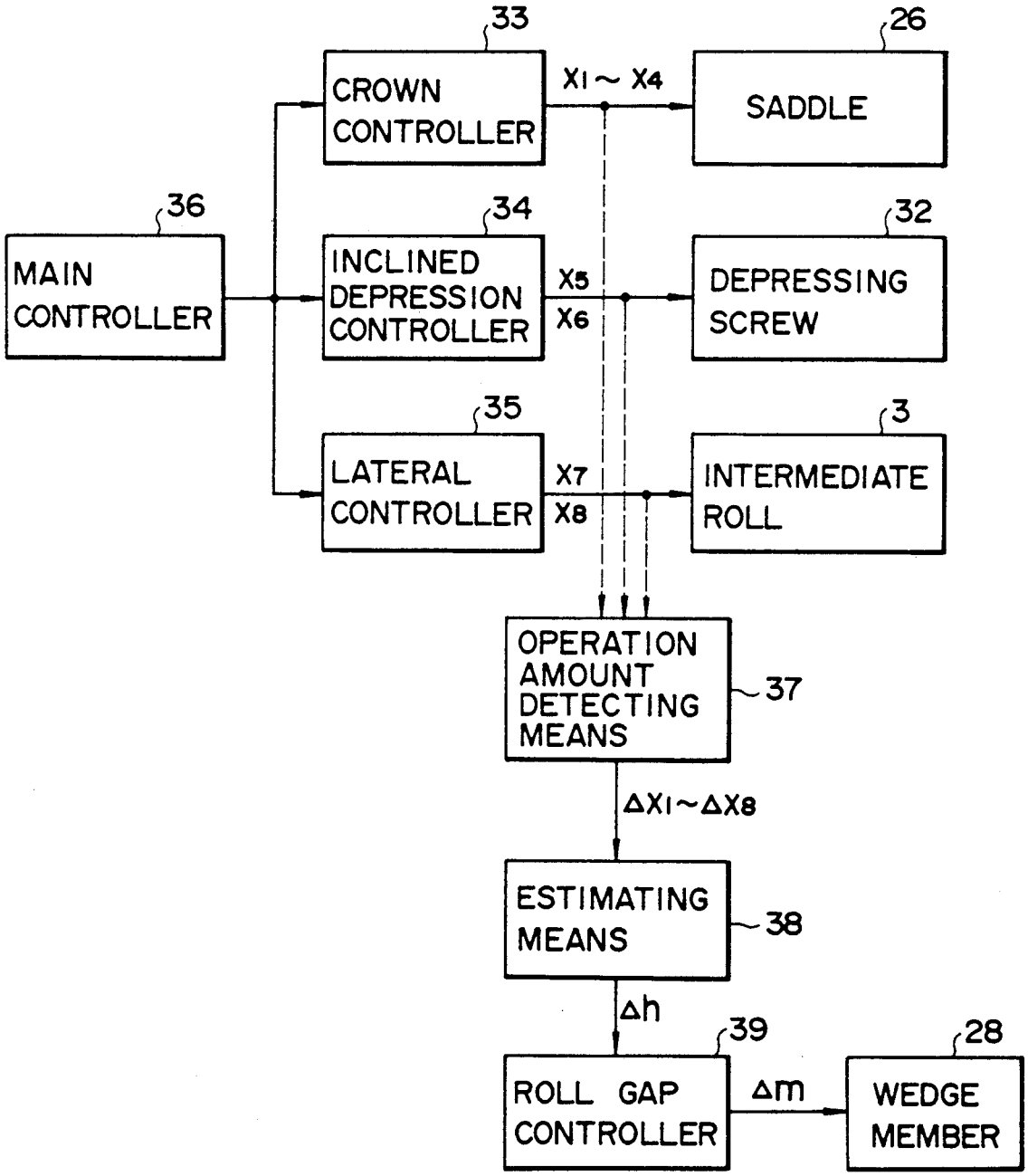
FIG. 5 is a block diagram of an entire device for controlling a shape of a rolled material on a multi-high rolling mill according to the present invention.
Figure 6:
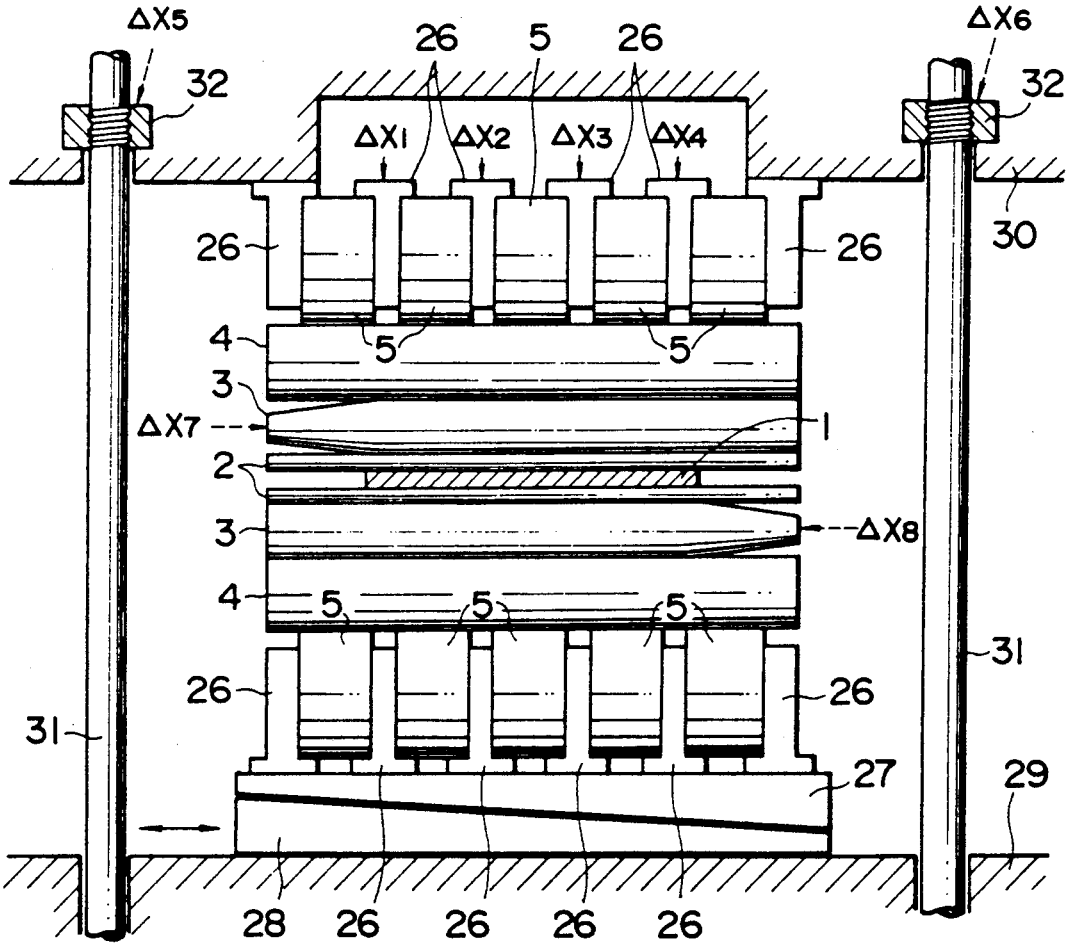
FIG. 6 is a front elevational view showing the multi-high rolling mill shown in FIG. 5.

Referring now to FIGS. 5 and 6, there is shown a device for controlling a shape of a rolled material on a multi-high rolling mill according to the present invention. In the present embodiment, the device of the present invention is applied to a 20-high rolling mill.

Referring first to FIG. 6, the 20-high rolling mill shown includes a pair of upper and lower work rolls 2 for contacting with a rolled material 1 in the form of a thin strip, two first intermediate rolls 3 disposed for individual axial movement behind each of the work rolls 2 and each having tapers at the opposite end portions thereof, three second intermediate rolls 4 disposed behind each set of the first intermediate rolls 3, and a plurality of divided backup rolls 5 disposed behind each set of the second intermediate rolls 4. The divided backup rolls 5 are divided axially into 5 parts and supported by 6 saddles 26 at each of the upper and lower positions so that the forcing amount of each of the divided backup rolls 5 may be adjusted by way of the individual saddles 6. The 20-high rolling mill is thus constituted from the rolls 2 to 5.

The 20-high rolling mill further includes a saddle receiver 27 for receiving thereon the lower side divided backup rolls 5 by way of the saddles 26, and a wedge member 28 disposed between a lower face of the saddle receiver 27 and a lower housing 29. When the wedge member 28 is moved leftwardly or rightwardly in FIG. 1(*b*), the saddle receiver 27 is moved downwardly or upwardly by the wedge member 28 thereby to change the gap (roll gap) between the upper and lower work rolls 2 uniformly in the axial direction by way of the rolls 5, 4 and 3.

The 20-high rolling mill further includes an upper housing 30, and a pair of columns 11 provided on the driving side and the working side and extending between the lower and upper housings 29 and 30. A depressing screw (depressing driving mechanism) 32 is provided at an upper end portion of each of the columns 31 such that, when it is rotated, the gap between the upper and lower work rolls 2 may be adjusted relatively between the driving side and the working side by way of the housings 29 and 30 and the rolls 5, 4 and 3.

Referring now to FIG. 5, the controlling device includes a crown controlling device 33 for locally controlling the forcing amounts of the individual divided backup rolls 5 by way of the saddles 26, an inclined depression controlling device 34 for adjusting the gap between the upper and lower work rolls 2 relatively between the driving side and the working side by means of the depressing screws 32, a lateral controlling device 35 for changing deflections at the opposite end portions of the upper and lower work rolls 2, and a main controller 36 for generally monitoring and controlling the individual controlling devices 33 to 35.

The controlling device further includes an operation amount detecting means 37 for detecting operation amounts x1 to x8 by the individual controlling devices 33 to 35, and an estimating means 38 for estimating a variation $\Delta h$ of the outgoing side strip thickness of the rolled material involved in strip shape control of the rolled material 1 by the controlling devices 33 to 35. While detailed description of an estimating procedure by the estimating means 38 will be given hereinbelow, a changing amount of the outgoing side strip thickness of the rolled material 1 is estimated basically from influence coefficients $\alpha i$ ($i=1\sim8$) which are found out in advance as amounts of influences which are had on the outgoing side strip thickness of the rolled material 1 by variations of individual operation amounts and also from variations $\Delta x1$ to $\Delta x8$ of individual operation amounts x1 to x8 detected by the operation amount detecting means 37.

The controlling device further includes a roll gap controlling device 39 for moving the wedge member 28 leftwardly or rightwardly to move the saddle receiver 27 upwardly or rightwardly to change and control the gap between the upper and lower work rolls 2 uniformly in the axial direction. The roll gap controlling device 39 controls, in response to an estimated value $\Delta h$ from the estimating means 38, the vertical position of the saddle receivers 27 by way of the wedge member 28 so as to cancel a change of the outgoing side strip thickness of the rolled material 1 corresponding to the estimated value $\Delta h$ in order to change the gap between the upper and lower work rolls 2 uniformly in the axial direction.

Since the rolled material shape controlling device of the embodiment of the present invention has such a construction as described above, strip shape control of the rolled material 1 proceeds in the following manner.

At first, when control of the strip shape of the rolled material 1 is to be performed by way of the crown controlling device 33, inclined depression controlling device 34 and lateral controlling device 35, instruction operation amounts from the individual controlling devices 33 to 35 are transmitted to the saddles 26, depressing screws 32 and intermediate rolls 3, respectively, so that the positions and so forth of the saddles 26, depressing screws 32 and intermediate rolls 3 all serving as strip shape controlling actuators are controlled.

In this instance, the operation amounts x1 (t) to x8 (t) from the individual controlling devices 13 to 15, that is, current positions of the individual actuators (saddles 26, depressing screws 32 and intermediate rolls 3), are detected by the operation amount detecting means 37, and variations $\delta x1$ to $\delta x8$ of the individual operation amounts are detected as variations from respective reference values $x1^0$ to $x8^0$. In short, $$\delta x1(t)=x1(t)-x1^0(i=1\sim8)$$

is obtained.

Then at the estimating means 38, the results of detection $\delta x1$ (t) are multiplied by an influence coefficient (amount of an influence which is had on the outgoing side strip thickness of the rolled material 1 by a variation $\delta x1$) found out in advance to estimate a strip thickness variation (variation of the outgoing side strip thicknesses of the rolled material 1) δh just below the rolls as $$\delta h(t) = \sum_{i=1}^{8} \alpha i \cdot \delta x i(t)$$

The estimated value δh obtained in this manner is transmitted to the roll gap controlling device 39, at which the estimated value δh is multiplied by a prescribed proportional gain β as $$\delta m(t) = \beta \cdot \delta h(t)$$

to obtain a position instruction value δm of the wedge member 28, and the wedge member 28 is driven in accordance with the position instruction value δm.

By moving the wedge member 28 by the position instruction value δm in a horizontal direction, the vertical position of the saddle receiver 27 is controlled by a suitable amount to change the gap between the upper and lower work rolls 2 uniformly in the axial direction to control the strip thickness of the rolled material 1 so that a change of the outgoing side strip thickness of the rolled material 1 corresponding to the estimated value δh(t) may be cancelled.

Such a technique as described above was actually applied to rolling of a strip width of 635 mm from 0.9 mm thick to 0.7 mm thick. As a result, the variation of the outgoing side strip thickness based on operation of the strip shape actuators (saddles 26, depressing screws 32 and intermediate rolls 3) was successfully reduced from 10 and several μm to 1 to 2 μm.

With the rolled material shape controlling device of the present embodiment, the gap between the upper and lower work rolls 2 is controlled by way of the saddle receiver 27 holding the saddles 26 for the divided backup rolls 5 thereon by horizontal movement of the wedge member 28 in response to an instruction value from the roll gap controlling device 39. Consequently, even if the position of the wedge member 28 changes, little deflection of the work rolls 2 takes place.

Accordingly, when strip shape control of the rolled material 1 is executed by the individual controlling devices 33 to 35, the gap between the work rolls 2 is changed uniformly in the axial direction by controlling the vertical position of the saddle receiver 27 by means of the roll gap controlling device 39 in accordance with a changing amount (estimated value δh) of the outgoing side strip thickness of the rolled material 1 estimated by the estimating means 38. Consequently, strip thickness control is executed without having an influence on strip shape control, and a change of the outgoing side strip thickness of the rolled material 1 corresponding to the estimated value δh is cancelled. As a result, shape control with a very high degree of accuracy can be achieved with certainty.

It is to be noted that, when the controlling device of the present embodiment was used actually, since the lateral influence coefficient upon the outgoing side strip thickness was very small and $\alpha 7 \mp \alpha 8 \mp 0$, even though a variation in operation amount by the lateral controlling device 35 detected by the operation amount detecting means 37 was not inputted to the outgoing side strip thickness estimating means 38, it was able to obtain sufficient accuracy in control.

It is to be noted that, while the method of and the apparatus for the present invention are applied, in the embodiments described above, to a 20-high rolling mill, they can naturally be applied to any other multi-high rolling mill.

Having now fully described the invention, it will be apparent to one of ordinary skill in the art that many changes and modifications can be made thereto without departing from the spirit and scope of the invention as set forth herein.

What is claimed is:

1. A method of controlling the shape of a rolled material on a multi-high rolling mill which includes a strip shape meter for detecting an elongation in a rolling direction of a rolled material on the outgoing side of said multi-high rolling mill as a strip shape, a strip shape controlling actuator for controlling the strip shape of the rolled material, a strip thickness controlling actuator for controlling a strip thickness of the rolled material, a strip shape controlling device for outputting an operation amount to said strip shape controlling actuator to control said strip shape controlling actuator in accordance with a result of detection by said strip shape meter, and a strip thickness controlling device for outputting an operation amount to said strip thickness controlling actuator to control said strip thickness controlling actuator, and wherein the strip shape and the strip thickness of the rolled material are controlled by said strip shape controlling device and said strip thickness controlling device while correcting the operation amount from said strip thickness controlling device taking into consideration a change of the strip thickness which is caused by changing the operation amount of said strip shape controlling actuator said method comprising the steps of:

defining and setting in advance a total performance index with which a strip shape and a strip thickness on the outgoing side of the rolled material are to be evaluated using a difference between a preset target strip shape and a strip shape on the outgoing side of said multi-high rolling mill detected by said strip shape meter and a difference between a strip thickness variation caused by a change of the operation amount of each of the actuators and a preset target strip thickness variation upon changing of the operation amount of each of the actuators:

normally detecting, during strip shape control of the rolled material, the strip shape of the rolled material by means of said strip shape meter:

calculating, in accordance with a result of detection from said strip shape meter, operation amounts for said strip shape controlling actuator and said strip thickness controlling actuator which makes the value of the total performance index minimum; and controlling said strip shape controlling actuator in accordance with an operation amount calculated by said strip shape controlling device and controlling said strip thickness controlling actuator in accordance with an operation amount obtained by adding an operation amount calculated by said strip shape controlling device to an operation amount from said strip thickness controlling device.

2. A method of controlling the shape of a rolled material on a multi-high rolling mill which includes a strip shape meter for detecting an elongation in a rolling direction of a rolled material on the outgoing side of said multi-high rolling mill as a strip shape, a strip shape controlling actuator for controlling the strip shape of the rolled material, a strip thickness controlling actuator for controlling a strip thickness of the rolled material, a strip shape controlling device for outputting an operation amount to said strip shape controlling actuator to control said strip shape controlling actuator in accordance with a result of detection by said strip shape meter, and a strip thickness controlling device for outputting an operation amount to said strip thickness actuator to control said strip thickness controlling actuator, and wherein the strip shape and the strip thickness of the rolled material are controlled by said strip shape controlling device and said strip thickness controlling device while correcting the operation amount from said strip thickness controlling device taking into consideration a change of the strip thickness which is caused by changing the operation amount of said strip shape controlling actuator, said method comprising the steps of:

defining and setting in advance a total performance index with which a strip shape and a strip thickness on the outgoing side of the rolled material are to be evaluated using a difference between a preset target strip shape at present and a strip shape at present on the outgoing side of said multi-high rolling mill detected by said strip shape meter and a difference between a strip thickness variation caused by a change of the operation amount of each of the actuators and a preset target strip thickness variation upon changing of the operation amount of each of the actuators:

normally detecting, during strip shape control of the rolled material, the strip shape of the rolled material by means of said strip shape meter:

calculating, in accordance with a result of detection from said strip shape meter, operation amounts for said strip shape controlling actuator and said strip thickness controlling actuator which makes the value of the total performance index minimum; and controlling said strip shape controlling actuator in accordance with an operation amount calculated by said strip shape controlling device and controlling said strip thickness controlling actuator in accordance with an operation amount obtained by adding an operation amount calculated by said strip shape controlling device to an operation amount from said strip thickness controlling device.

3. A method of controlling the shape of a rolled material on a multi-high rolling mill which includes a strip shape meter for detecting an elongation in a rolling direction of a rolled material on the outgoing side of said multi-high rolling mill as a strip shape, a strip shape controlling actuator for controlling the strip shape of the rolled material, a strip thickness controlling actuator for controlling a strip thickness of the rolled material, a strip shape controlling device for outputting an operation amount to said strip shape controlling actuator to control said strip shape controlling actuator in accordance with a result of detection by said strip shape meter, and a strip thickness controlling device for outputting an operation amount to said strip thickness controlling actuator to control said strip thickness controlling actuator, and wherein the strip shape and the strip thickness of the rolled material are controlled by said strip shape controlling device and said strip thickness controlling device while correcting the operation amount from said strip thickness controlling device taking into consideration a change of the strip thickness which is caused by changing the operation amount of said strip shape controlling actuator, said method comprising the steps of:

defining and setting in advance a total performance index with which a strip shape and a strip thickness on the outgoing side of the rolled material are to be evaluated using a difference between a preset target strip shape and a strip shape on the outgoing side of said multi-high rolling mill detected by said strip shape meter and a difference between a strip thickness variation caused by a change of the operation amount of each of the actuators and a preset target strip thickness variation upon changing of the operation amount of each of the actuators;

normally detecting, during strip shape control of the rolled material, the strip shape of the rolled material by means of said strip shape meter;

calculating, in accordance with a result of detection from said strip shape meter and a limit of movement of each of the actuators which depends upon a current position and an upper limit of the moving speed of the actuator, operation amounts for said strip shape controlling actuator and said strip thickness controlling actuator which make the value of the total performance index minimum; and controlling said strip shape controlling actuator in accordance with an operation amount calculated by said strip shape controlling device and controlling said strip thickness controlling actuator in accordance with an operation amount obtained by adding an operation amount calculated by said strip shape controlling device to an operation amount from said strip thickness controlling device.

4. A method of controlling the shape of a rolled material on a multi-high rolling mill which includes a strip shape meter for detecting an elongation in a rolling direction of a rolled material on the outgoing side of said multi-high rolling mill as a strip shape, a strip shape controlling actuator for controlling the strip shape of the rolled material, a strip thickness controlling actuator for controlling a strip thickness of the rolled material, a strip shape controlling device for outputting an operation amount to said strip shape controlling actuator to control said strip shape controlling actuator in accordance with a result of detection by said strip shape meter, and a strip thickness controlling device for outputting an operation amount to said strip thickness controlling actuator, and wherein the strip shape and the strip thickness of the rolled material are controlled by said strip shape controlling device and said strip thickness controlling device while correcting the operation amount from said strip thickness controlling device taking into consideration a change of the strip thickness which is caused by changing the operation amount of said strip shape controlling actuator, said method comprising the steps of:

defining and setting in advance a total performance index with which a strip shape and a strip thickness on the outgoing side of the rolled material are to be evaluated using a difference between a preset target strip shape at present and a strip shape at present on the outgoing side of said multi-high rolling mill detected by said strip shape meter and a difference between a strip thickness variation caused by a change of the operation amount of each of the actuators and a preset target strip thickness variation upon changing of the operation amount of each of the actuators;

normally detecting, during strip shape control of the rolled material, the strip shape of the rolled material by means of said strip shape meter;

calculating, in accordance with a result of detection from said strip shape meter and a limit of movement of each of the actuators which depends upon a current position and an upper limit of the moving speed of the actuator, operation amounts for said strip shape controlling actuator and said strip thickness controlling actuator which make the value of the total performance index minimum; and controlling said strip shape controlling actuator in accordance with an operation amount calculated by said strip shape controlling device and controlling said strip thickness controlling actuator in accordance with an operation amount obtained by adding an operation amount calculated by said strip shape controlling device to an operation amount from said strip thickness controlling device.

5. A method of controlling the shape of a rolled material on a multi-high rolling mill according to claim 2 or 4, wherein an operation amount is calculated after a difference between a strip shape at present on the outgoing side of said multi-high rolling mill detected by said strip shape meter and a preset target strip shape at present is replaced by a weighted average value of a sequence of data of differences of strip shapes at present and in the past on the outgoing side of said multi-high rolling mill detected by said strip shape meter from corresponding preset target strip shapes at present and in the past.

6. An apparatus for controlling the shape of a rolled material on a multi-high rolling mill, which includes a crown controlling device for locally controlling the forcing amount of each of a plurality of axially divided backup rolls which are supported on saddles, an inclined depression controlling device for adjusting the gap between the upper and lower work rolls relatively between the driving side and the working side by means of depressing driving mechanisms provided on the driving side and the working side, and a lateral controller for adjusting the axial positions of intermediate rolls each of which has a taper at each of the opposite end portions thereof and is mounted for movement in its axial direction in order to to change deflections at the opposite end portions of said upper and lower work rolls, said apparatus comprising:

a saddle receiver on which said plurality of divided backup rolls are placed by way of said saddles;

a roll gap controlling device for moving said saddle receiver upwardly or downwardly to change and control the gap between said upper and lower work rolls uniformly in the axial direction;

operation amount detecting means for individually detecting operation amounts of said crown controlling device, inclined depression controlling device and lateral controlling device; and an estimating means for estimating a variation of the strip thickness of the rolled material on the outgoing side of said multi-high rolling mill in accordance with influence coefficients obtained in advance as amounts of influences which are to be had on the strip thickness of the rolled material on the outgoing side by variations of the operation amounts caused by said crown controlling device, inclined depression controlling device and lateral controlling device and also with variations of the individual operation amounts detected by said operation amount detecting means;

wherein said roll gap controller controls the vertical position of said saddle receiver in accordance with an estimated value from said estimating means so as to cancel a change of the strip thickness of the rolled material on the outgoing side corresponding to the estimated value in order to change the gap between said upper and lower work rolls uniformly in the axial direction.

* * * * *